US009747907B2

(12) United States Patent
Tachibana et al.

(10) Patent No.: US 9,747,907 B2
(45) Date of Patent: Aug. 29, 2017

(54) DIGITAL WATERMARK DETECTING DEVICE, METHOD, AND PROGRAM

(71) Applicant: KABUSHIKI KAISHA TOSHIBA, Minato-ku, Tokyo (JP)

(72) Inventors: Kentaro Tachibana, Kanagawa (JP); Masahiro Morita, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 15/150,520

(22) Filed: May 10, 2016

(65) Prior Publication Data

US 2016/0254003 A1 Sep. 1, 2016

Related U.S. Application Data

(63) Continuation of application No. PCT/JP2013/080466, filed on Nov. 11, 2013.

(51) Int. Cl.
*G10L 19/018* (2013.01)
*G10L 25/51* (2013.01)
(Continued)

(52) U.S. Cl.
CPC ..... *G10L 19/018* (2013.01); *G10L 25/51* (2013.01); *G10L 25/87* (2013.01); *G10L 25/90* (2013.01)

(58) Field of Classification Search
CPC ..... G10L 19/018
(Continued)

(56) References Cited

U.S. PATENT DOCUMENTS 6,438,236 B1 8/2002 Best et al.
9,305,559 B2 * 4/2016 Sharma ..... G10L 19/018
(Continued)

FOREIGN PATENT DOCUMENTS

JP 10-512110 A 11/1998
JP 2002-169579 A 6/2002
(Continued)

OTHER PUBLICATIONS

Tachibana, Kentaro et al.: "Iso Hencho ni Motozuku HMM Onsei Gosei Muke Denshi Sukashi Hoshiki no Teian (A Proposal of an Watermarking Method Based on Phase Modulation for HMM-Based Speech-Synthesis)", *Acoustical Society of Japan 2013 Spring Meeting*, pp. 135-136, 2013.
(Continued)

*Primary Examiner* — Susan McFadden
(74) *Attorney, Agent, or Firm* — Foley & Lardner LLP

(57) ABSTRACT

According to an embodiment, a digital watermark detecting device includes a residual signal extractor, a voiced period estimator, a storage, a phase estimator, and a watermark determiner. The residual signal extractor is configured to extract a residual signal from a speech signal. The voiced period estimator is configured to estimate a voiced period based on the speech signal. The storage is configured to store pulse signals modulated in advance so as to have different phases. The phase estimator is configured to clip the voiced period in units of an analysis frame having a predetermined length, and perform pattern matching between the residual signal in the analysis frame and the pulse signals to estimate phase of the speech signal. The watermark determiner is configured to, based on a sequence of phases estimated by the phase estimator, determine whether a digital watermark is embedded in the speech signal or not.

16 Claims, 6 Drawing Sheets

(51) Int. Cl.
*G10L 25/87* (2013.01)
*G10L 25/90* (2013.01)

(58) Field of Classification Search
USPC ..... 704/207
See application file for complete search history.

(56) References Cited

U.S. PATENT DOCUMENTS

| | | | | |
|---|---|---|---|---|
| 9,401,153 | B2 * | 7/2016 | Sharma | G10L 19/018 |
| 2003/0059082 | A1 | 3/2003 | Suzuki et al. | |
| 2005/0152549 | A1 | 7/2005 | Lemma et al. | |
| 2010/0317396 | A1 | 12/2010 | Reynolds et al. | |
| 2015/0325232 | A1 | 11/2015 | Tachibana et al. | |

FOREIGN PATENT DOCUMENTS

| | | | |
|---|---|---|---|
| JP | 2003-044067 | A | 2/2003 |
| JP | 2005-521908 | A | 7/2005 |
| JP | 2010-530154 | A | 9/2010 |
| WO | WO-2014/112110 | A1 | 7/2014 |

OTHER PUBLICATIONS

Talkin, D.: "Voicing Epoch Determination With Dynamic Programming", *J. Acoust. Soc. Am. Suppl. 1*, vol. 85, Spring 1989.
Written Opinion dated Feb. 10, 2014 as received in corresponding PCT Application No. PCT/JP2013/080466 and its English translation thereof.

* cited by examiner

DIGITAL WATERMARK DETECTING DEVICE, METHOD, AND PROGRAM

CROSS-REFERENCE TO RELATED APPLICATIONS

This application is a continuation of PCT international Application Ser. No. PCT/JP2013/080466, filed on Nov. 11, 2013, which designates the United States; the entire contents of which are incorporated herein by reference.

FIELD

The present invention relates to a digital watermark detecting device, a method, and a program.

BACKGROUND

In recent years, there has been remarkable progress in staticstical parametric speech synthesis, particularly HMM (hidden Markov Model (HMM)-based speech synthesis has been activity studied). Since the HMM-based speech synthesis enables speaker adaptation with ease, it is characterized by the ability to enable creation of a speech synthesis dictionary even from only a small volume of speech. For that reason, even an average user can casually create a speech synthesis dictionary; and it is believed that, in future, average users would disclose and share speech synthesis dictionaries with each other thereby resulting in the expansion of the speech synthesis technology.

On the other hand, a user with bad intent may use the speech synthesis dictionary of some other person to impersonate that other person, or a speech synthesis dictionary can be created from a speech that is fraudulently obtained from media such as TV or the Internet. Thus, there is an increasing concern about fraudulent use of speech synthesis dictionaries. Thus, in future, if speech synthesis can be done at a substantially equivalent level to the human beings, there is a concern about the abuse of synthesized speeches, such as using the voices of famous people without permission for doing promotion or impersonating other persons and making phone calls.

In that regard, prevention/suppression of impersonation can be achieved if a digital watermark is embedded in the synthetic speech, and if the receiving side of the synthesized speech with an embedded digital watermark detects the watermark and informs the user on the receiving side that a synthesized voice is received. This digital watermark embedding method can be used in pulse-driven speech synthesis systems in general.

DETAILED DESCRIPTION

According to an embodiment, a digital watermark detecting device includes a residual signal extractor, a voiced period estimator, a storage, a phase estimator, and a watermark determiner. The residual signal extractor is configured to extract a residual signal from a speech signal. The voiced period estimator is configured to estimate a voiced period based on the speech signal. The storage is configured to store a plurality of pulse signals modulated in advance to have a plurality of different phases. The phase estimator is configured to clip the voiced period in units of an analysis frame having a predetermined length, and perform pattern matching between the residual signal in the analysis frame and the plurality of pulse signals to estimate phase of the speech signal. The watermark determiner is configured to, based on a sequence of phases estimated by the phase estimator, determine whether a digital watermark is embedded in the speech signal or not.

An exemplary embodiment of a digital watermark detecting device is described below with reference to the accompanying drawings. The digital watermark detecting device according to the embodiment detects a digital watermark embedded in a synthesized speech. Herein, a synthetic speech is generated when filtering exhibiting vocal-tract features is performed with respect to source signals representing vocal cord vibration. Moreover, in the case of embedding a digital watermark in a synthesized speech, for example, the phases of pulse signals (voiced period), which represent the vocal cord vibration, of the source signals are modulated and the degree of modulation is treated as watermarking information; and a digital watermark is embedded in the synthesized speech. As a result, a synthesized speech is generated in which phase modulation is performed only with respect to the voiced period (see FIG. 8).

Figure 1:
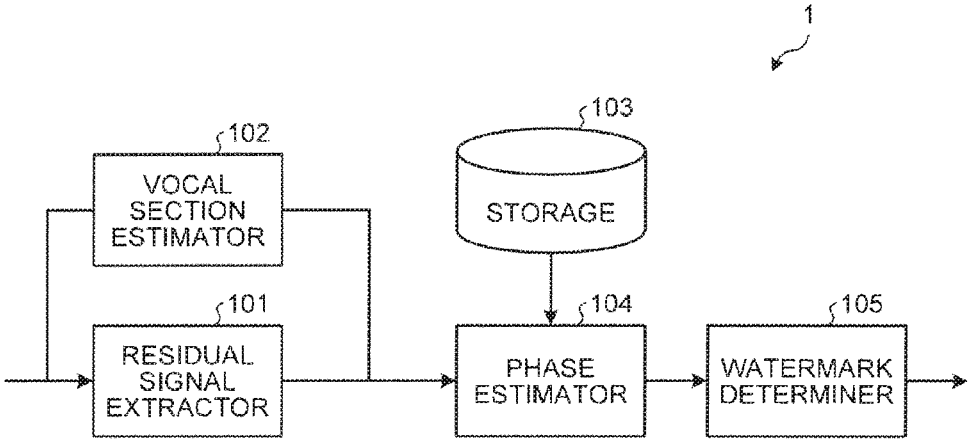
FIG. 1 is a block diagram illustrating a digital watermark detecting device according to an embodiment.

FIG. 1 is a block diagram illustrating a configuration of a digital watermark detecting device 1 according to the embodiment. The digital watermark detecting device 1 is implemented using a general-purpose computer. That is, the digital watermark detecting device 1 has the functions of, for example, a computer that includes a CPU, a memory device, an input-output device, and a communication interface.

As illustrated in FIG. 1, the digital watermark detecting device 1 includes a residual signal extractor 101, a voiced period estimator 102, a storage 103, a phase estimator 104, and a watermark determiner 105. The residual signal extractor 101, the voiced period estimator 102, the phase estimator 104, and the watermark determiner 105 can be configured using hardware circuitry or using software executed by the CPU. The storage 103 is configured using, for example, an HDD (Hard Disk Drive) or a memory. Thus, the digital watermark detecting device 1 can be configured to implement functions by executing a digital watermark detecting program.

The residual signal extractor 101 extracts a residual signals from a speech signal that is input, and outputs the residual signal to the phase estimator 104. More particularly, the residual signal extractor 101 performs speech analysis with respect to the speech signal that is input, and calculates spectrum envelope information. Examples of the speech analysis include linear predictive coefficient (LPC) analysis, partial autocorrelation coefficient (PARCOR) analysis, and line spectrum analysis. Then, the residual signal extractor 101 performs inverse filtering with respect to the spectrum envelope information, and extracts a residual signal from the speech signal.

The voiced period estimator 102 estimates a voiced period from the speech signal that is input, and outputs the voiced period to the phase estimator 104. More particularly, with respect to the speech signal that is input, the voiced period estimator 102 extracts a fundamental frequency ($F_0$) for every predetermined number of frames, and estimates a voiced period. The fundamental frequency $F_0$ is a non-zero value in a voiced period, and is equal to zero in a silent or unvoiced period. Alternatively, a voiced period can be estimated to be present if the correlation coefficient for each analysis frame is equal to or greater than a predetermined threshold value, or if the amplitude or the power of the input signal is equal to or greater than a predetermined threshold value, or if such values are equal to or greater than a predetermined threshold value. Herein, the voiced period estimator 102 can estimate the voiced period on a frame-by-frame basis.

The storage 103 is used to store a plurality of pulse signals (template signals) that have been modulated in advance to a plurality of different phases. More particularly, the storage 103 is used to store a plurality of pulse signals that are modulated by quantizing the phases between $-\pi$ to $\pi$ into a plurality of phase values.

The phase estimator 104 performs pattern matching of the residual signal in a voiced period with a plurality of pulse signals (template signals) stored in the storage 103, and estimates the phases of the residual signal. More particularly, the phase estimator 104 uses a plurality of pulse signals stored in the storage 103 as templates; performs, for each analysis frame, pattern matching with respect to the residual signal in each voiced period (frame) estimated by the voiced period estimator 102; and outputs a phase sequence.

Figure 2:
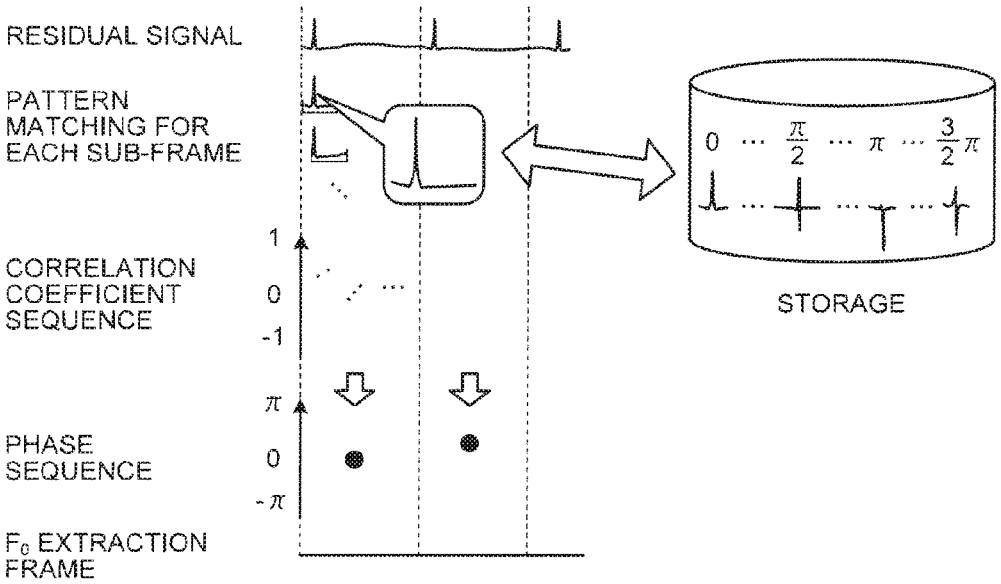
FIG. 2 is a schematic diagram illustrating the operations performed by a phase estimator.

FIG. 2 is a schematic diagram illustrating the operations performed by the phase estimator 104. Herein, the phase estimator 104 performs pattern matching by clipping sub-frames (analysis frames) having the same length as the pulse signals (template signals) in each frame having the fundamental frequency $F_0$ (each extracted frame). From among a plurality of pulse signals stored in the storage 103, the phase estimator 104 selects the pulse signal that has the highest similarity to the residual signal in the concerned analysis frame. Then, the phase estimator 104 performs phase value estimation by setting the phase value of the selected pulse signal as the phase value of the residual signal.

The phase estimator 104 performs pattern matching based on, for example, correlation coefficient values or the difference in amplitude value. In the case of performing pattern matching based on correlation coefficient values, the phase estimator 104 firstly calculates a correlation coefficient with all template signals in, for example, a single sub-frame. Then, the phase estimator 104 performs an identical operation with respect to all of the remaining sub-frames, and creates a correlation coefficient sequence. Subsequently, the phase estimator 104 sets, as the phase value in the sub-frames, the phase value of the template signal for which the calculated correlation coefficient value is the largest in the correlation coefficient sequence. The phase estimator 104 performs such operations for each frame having the fundamental frequency $F_0$ to calculate the phase sequence on a frame-by-frame basis, and outputs the frame-by-frame phase sequences.

Also in the case of performing pattern matching based on the difference in amplitude value, the phase estimator 104 performs operations with respect to each sub-frame in an identical manner. That is, for all sub-frames, the phase estimator 104 calculates the absolute value of the difference in amplitude value regarding all template signals in each sub-frame. Then, the phase estimator 104 sets, as the phase value in the sub-frame, the phase value of the template signal having the smallest difference in amplitude value. The phase estimator 104 performs such operations for each frame having the fundamental frequency $F_0$ to calculate the phase sequence on a frame-by-frame basis, and outputs the frame-by-frame phase sequences.

Thus, as compared to the case in which the frame-by-frame phase sequences are calculated using the FFT, the phase estimator 104 can perform phase estimation without having to depend on the pitch mark accuracy. Moreover, since the phase estimator 104 performs the operation of waveform pattern matching in all time domains, the amount of operations can be held down as compared to the operations performed in frequency domains.

The watermark determiner 105 determines the presence or absence of a digital watermark in a speech signal based on the phase sequences estimated by the phase estimator 104. More particularly, with respect to the sequences obtained by performing an unwrapping operation with respect to the phase sequences estimated by the phase estimator 104, the watermark determiner 105 calculates the inclination of the phases as an indication of a digital watermark embedded in a speech signal. When the inclination of a phase is close to zero (for example, when the inclination of a phase is equal to or smaller than a predetermined threshold value), the watermark determiner 105 determines that a digital watermark is not present. However, when a definitive inclination distant from zero is calculated for a phase (for example, when the inclination of a phase is equal to or greater than a predetermined threshold value), the watermark determiner 105 determines that a digital watermark is present.

Figure 3:
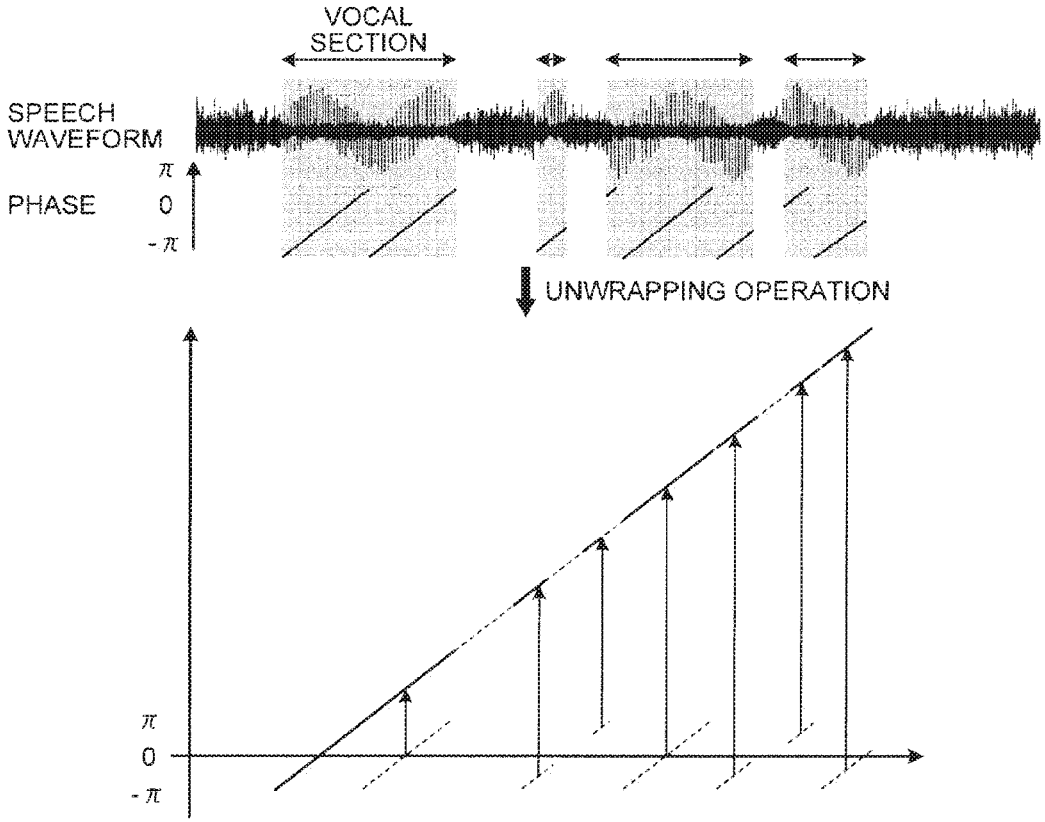
FIG. 3 is a diagram for explaining a brief overview of an unwrapping operation.

For example, regarding a synthesized speech embedded with a digital watermark, as illustrated in the middle portion of FIG. 3, the phases vary in a linear fashion in the range of $-\pi$ to $\pi$. The unwrapping operation implies serially connecting the phases of a synthesized speech in which a digital watermark is embedded.

As illustrated in FIG. 3, the watermark determiner 105 performs linear interpolation of the sections other than the voiced period. Moreover, the watermark determiner 105 partitions the phase sequence in short-lasting sections, calculates the inclination of each section, and creates an inclination histogram. Then, by setting the mode value of each histogram as the inclination of the corresponding phase of the speech signal, the watermark determiner 105 calculates, from the phase sequence, the inclination of the phases representing a digital watermark embedded in the speech signals.

Figure 8:
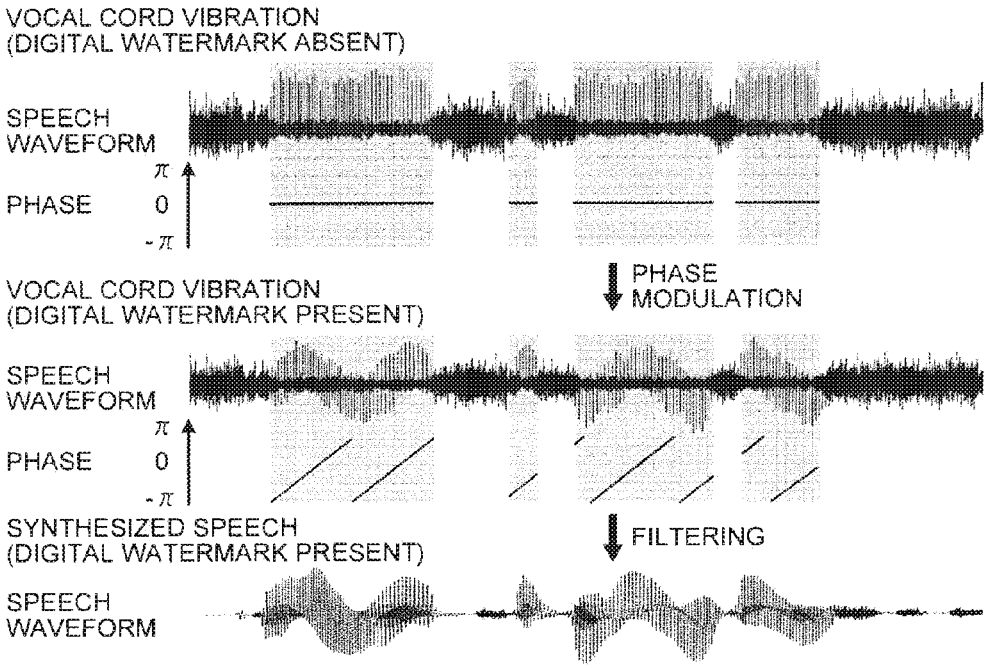
FIG. 8 is a diagram illustrating an example of a synthesized speech waveform that has been phase-modulated.

Meanwhile, the watermark determiner 105 can be alternatively configured to calculate the inclination not from the short-lasting sections but from the overall section length. As illustrated in FIG. 8, when a digital watermark is not included, the inclination of the phases becomes close to zero. When a digital watermark is included, the inclination of the phases varies according to the modulated frequency. The watermark determiner 105 determines the presence or absence of a digital watermark by, for example, comparing the inclination of the phases with a predetermined threshold value. Meanwhile, the inclination of a phase is expressed in Equation (1) given below.

$$ph_f(t)=2\pi at \bmod 2\pi \quad (1)$$

Herein, $ph_f$ represents a phase of the component of a frequency f of the pulse that has the center at a timing t; a represents the modulation frequency of the phase; and x mod y represents remainder obtained by dividing x by y.

Figure 4:
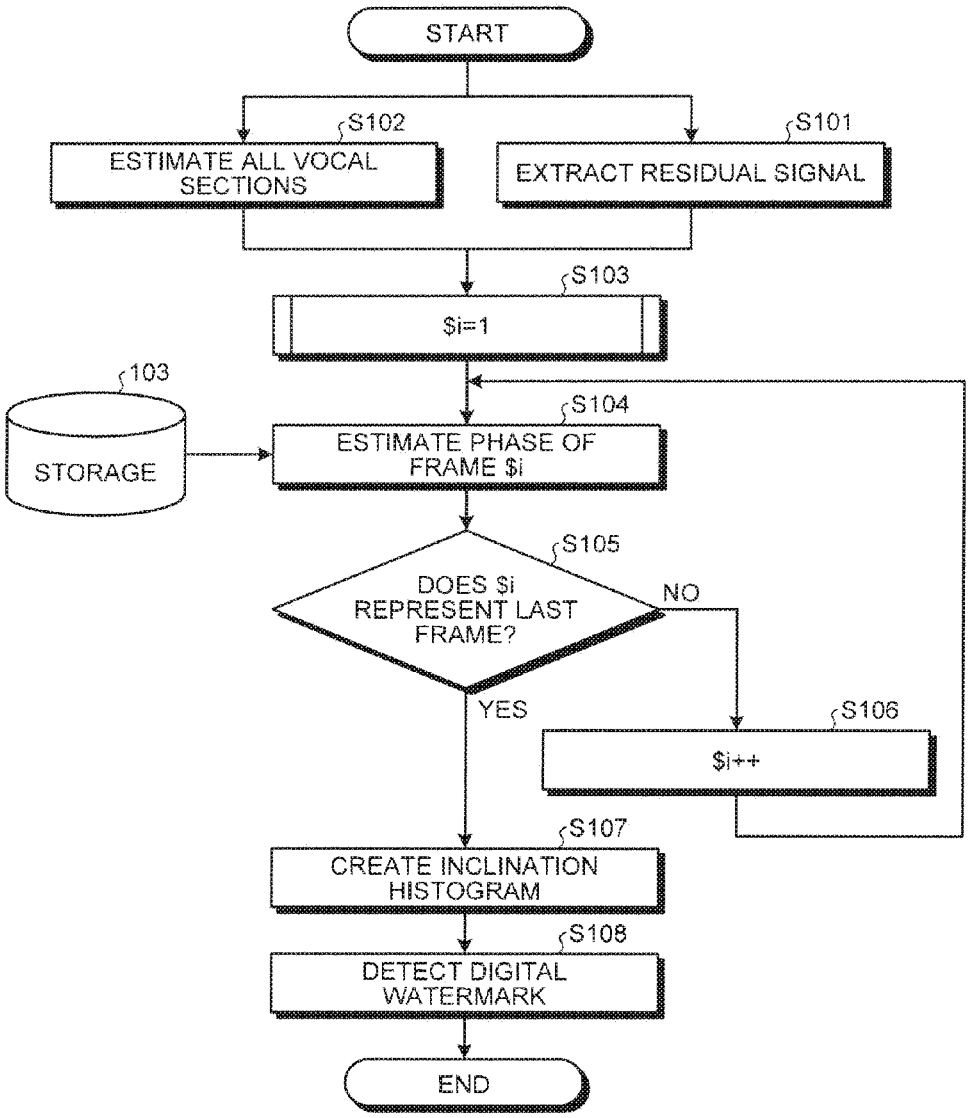
FIG. 4 is a diagram for explaining a flow of operations performed in the digital watermark detecting device.

Given below is the explanation of a flow of operations performed in the digital watermark detecting device 1. FIG. 4 is a diagram for explaining a flow of operations performed in the digital watermark detecting device 1. Firstly, the residual signal extractor 101 extracts a residual signal from a speech signal that is input (S101). Then, the voiced period estimator 102 estimates all voiced period (frames) from the input signal (S102).

Subsequently, the phase estimator 104 sets "1" in $i representing, for example, the order of frames in the operation performed at S103 and, for each frame estimated by the voiced period estimator 102, estimates phases using a plurality of pulse signals (template signals) stored in the storage 103 (S104).

The phase estimator 104 determines whether or not $i represents the last frame (S105). If $i does not represent the last frame (No at S105), then the system control proceeds to S106. On the other hand, if $i represents the last frame (Yes at S105), then the system control proceeds to S107.

The phase estimator 104 increments the value of $i so that $i represents the order of the next frame (S106).

After reaching the last frame, the watermark determiner 105 performs an unwrapping operation with respect to the estimated phase sequences, calculates the inclination for each short-lasting section, and creates an inclination histogram (S107).

The watermark determiner 105 detects the presence or absence of a digital watermark based on the mode value of the created histogram (S108).

MODIFICATION EXAMPLE

Figure 5:
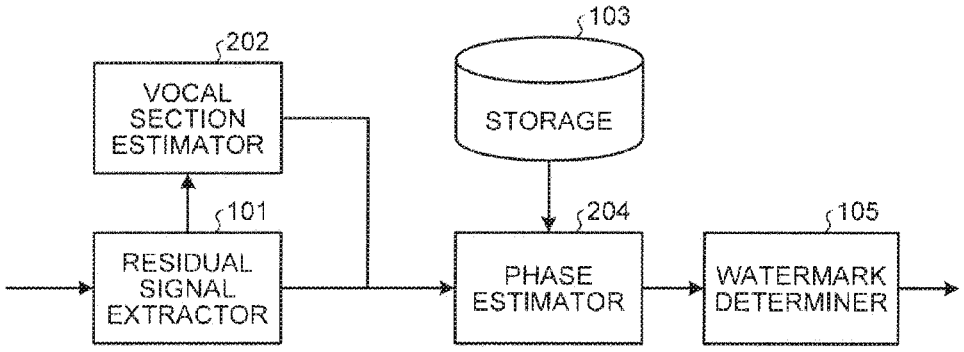
FIG. 5 is a block diagram illustrating the digital watermark detecting device according to a modification example.

Given below is the explanation of a modification example of the digital watermark detecting device 1. FIG. 5 is a block diagram illustrating a configuration of the digital watermark detecting device 1 according to the modification example. According to the modification example, the digital watermark detecting device 1 includes the residual signal extractor 101, a voiced period estimator 202, the storage 103, a phase estimator 204, and the watermark determiner 105. In the digital watermark detecting device 1 illustrated in FIG. 5 according to the modification example, the constituent elements that are substantively identical to the constituent elements of the digital watermark detecting device 1 illustrated in FIG. 1 are referred to by the same reference numerals.

The voiced period estimator 202 estimates voiced period using the residual signal extracted by the residual signal extractor 101. A residual signal simulates the vocal cord vibration of a human being, and has the pulse component appearing at regular time intervals. For example, the voiced period estimator 202 groups only those points (timings) at which the amplitude value or the power of the residual signal becomes equal to or greater than a predetermined threshold value, that is, groups only the pulse points. Then, regarding a particular point, if the interval (pulse interval) with the previous point and the interval (pulse interval) with the subsequent point are equal to or greater than a predetermined value, the voiced period estimation unit 202 sets that point as the start point. When a point of the same sort appears next, the voiced period estimator 202 sets that point as the end point and estimates a voiced period. The voiced period estimator 202 repeatedly performs this operation, and estimates voiced period. Then, the voiced period estimator 202 estimates the fundamental frequency $F_0$ for each frame, calculates the sequence of reciprocals of the fundamental frequency $F_0$ (i.e., calculates the sequence of pitch timings), estimates valid voiced period in cycles of the pitch timings, and outputs the valid voiced period to the phase estimator 204 (see FIG. 6).

The phase estimator 204 clips the valid voiced period as analysis frames and, in the leading frame in the sequence of pitch timings, sets, as the leading pitch mark, the timing having the largest amplitude value of the residual signal input from the residual signal extractor 101. Alternatively, the phase estimator 204 can obtain, in the leading frame in the sequence of pitch timings, the inclinations of local phases and can set, as the leading pitch mark, the point (timing) having the largest absolute value of the inclination.

Figure 6:
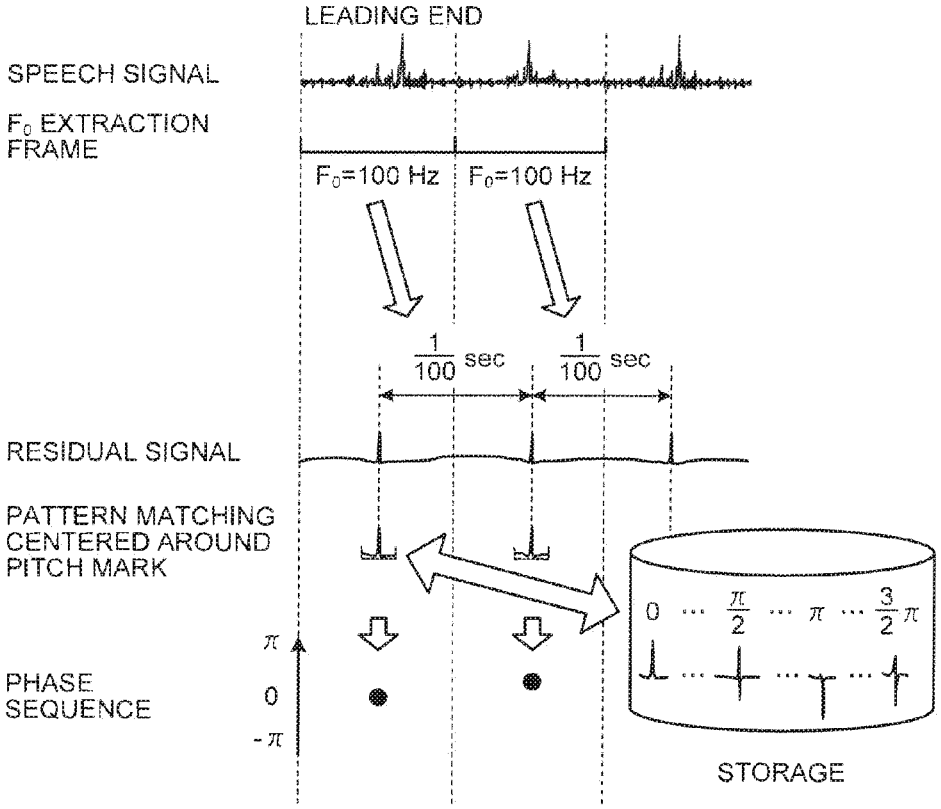
FIG. 6 is a schematic diagram illustrating operations performed in the digital watermark detecting device according to the modification example.

In the example illustrated in FIG. 6, the reciprocal of the fundamental frequency $F_0$ calculated by the voiced period estimator 202 is 1/100 sec. Thus, the phase estimator 204 estimates, as the new pitch mark, the timing reached after the pitch timing (1/100 sec) from the leading pitch mark. The phase estimator 204 repeatedly performs this operation, and estimates a pitch mark sequence.

Moreover, regarding each pitch mark, the phase estimator 204 performs pattern matching for the sub-frame (analysis frame) having the concerned pitch mark (timing) at the center, and estimates a phase sequence in an identical manner to the phase estimator 104.

In the example illustrated in FIG. 6, the phase estimator 204 performs pattern matching only at the pitch mark positions (timings). However, that is not the only possible case. Alternatively, for example, the phase estimator 204 can be configured to perform pattern matching also at the periphery of the pitch mark positions, and use the phase values of the pulse signals (template signals) having the highest degree of similarity.

In this way, unlike the operations performed on a frame-by-frame basis by the phase estimator 104 illustrated in FIG. 1, the phase estimator 204 illustrated in FIG. 5 performs phase estimation for each pitch mark. Hence, estimation of phases can be performed in an accurate manner while holding down the amount of operations. Then, the watermark determiner 105 determines the presence or absence of a digital watermark by referring to the phase sequences estimated in the manner described above.

Figure 7:
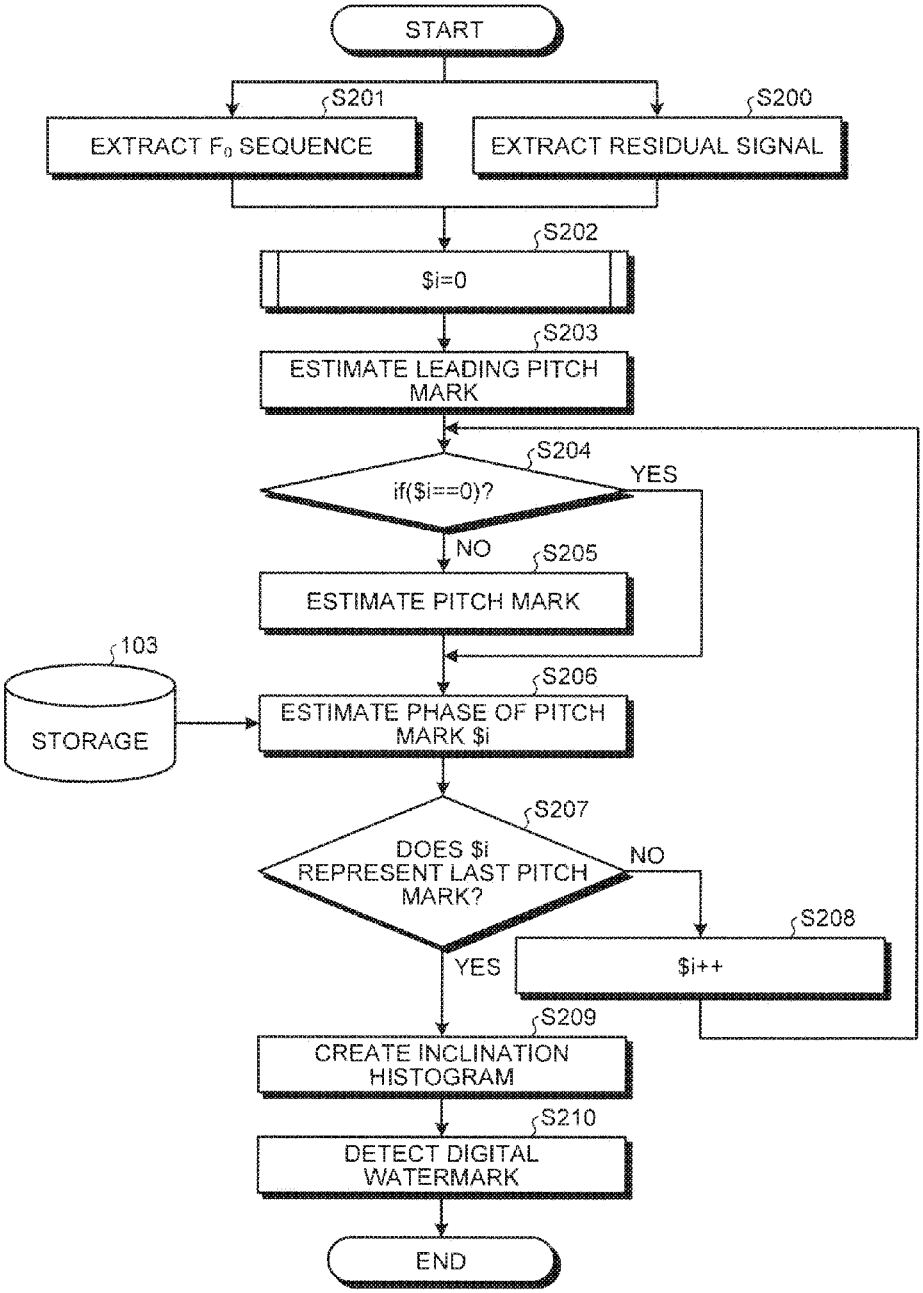
FIG. 7 is a diagram for explaining a flow of operations performed in the digital watermark detecting device according to the modification example.

Given below is the explanation of the operations performed in the digital watermark detecting device 1 according to the modification example. FIG. 7 is a diagram for explaining a flow of operations performed in the digital watermark detecting device 1 according to the modification example. Firstly, the residual signal extractor 101 extracts a residual signal from the speech signal that is input (S200). Then, the voiced period estimator 202 extracts the sequence of frame-by-frame fundamental frequency $F_0$, calculates the sequence of reciprocals of the fundamental frequency $F_0$ (i.e., calculates the sequence of pitch timings), and outputs the result to the phase estimator 204 (S201).

Subsequently, the phase estimator 204 sets "0" in $i representing, for example, the order of pitch marks in the operation performed at S202, and estimates the leading pitch mark in the leading frame that has the fundamental frequency $F_0$ (S203).

The phase estimator 204 determines whether or not $i is set to "0" (S204). If $i is not set to "0" (No at S204), then the system control proceeds to S205. On the other hand, if $i is set to "0" (Yes at S204), then the system control proceeds to S206.

When $1 is not set to "0", the phase estimator 204 estimates, as the new pitch mark, the timing reached after the pitch timing from the leading pitch mark (S205).

For each sub-frame (analysis frame) having the estimated pitch mark (timing) at the center, the phase estimator 204 performs pattern matching using a plurality of pulse signals (template signals) stored in the storage 103, and estimates phases (S206).

The phase estimator 204 determines whether or not $i represents the last pitch mark (S207). If $i does not represent the last pitch mark (No at S207), then the system control proceeds to S208. On the other hand, if $i represents the last pitch mark (No at S207), then the system control proceeds to S209.

The phase estimator 204 increments the value $1 so that $i represents the order of the next pitch mark (S208).

After reaching the last pitch mark, the watermark determiner 105 performs an unwrapping operation with respect to the estimated phase sequences, calculates the inclination for each short-lasting section, and creates a phase inclination histogram (S209).

The watermark determiner 105 detects the presence or absence of a digital watermark based on the mode value of the created histogram (S210).

Meanwhile, the digital watermark detecting device 1 (or the modification example of the digital watermark detecting device 1) can be configured in such a way the phase estimator 104 illustrated in FIG. 1 and the phase estimator 204 illustrated in FIG. 5 can be replaced with each other.

Meanwhile, programs executed in the digital watermark detecting device 1 according to the present embodiment and the modification example are recorded as installable or executable files in a computer-readable recording medium, which may be provided as a computer program product, such as a CD-ROM, a flexible disk (FD), a CD-R, or a DVD (Digital Versatile Disk).

Alternatively, the programs according to the present embodiment can be stored in a computer that is connected to a network such as the Internet, and can be downloaded via the network.

In this way, the digital watermark detecting device 1 and the modification example thereof can perform pattern matching between the residual signal in an analysis frame and a plurality of pulse signals, and estimate the phases of the speech signal. Hence, a digital watermark embedded in the synthesized speech can be detected while holding down the amount of operations.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A digital watermark detecting device comprising:

a residual signal extractor configured to extract a residual signal from a speech signal;

a voiced period estimator configured to estimate a voiced period based on the speech signal;

a storage configured to store a plurality of pulse signals modulated phases in advance to have a plurality of different phases;

a phase estimator configured to clip the voiced period in units of an analysis frame having a predetermined length, and perform estimating the phase based on pattern matching between the residual signal in the analysis frame and a plurality of the pulse signals modulated phases; and a watermark determiner configured to, based on a sequence of phases estimated by the phase estimator, determine presence or absence of a digital watermark in the speech signal.

2. The device according to claim 1, wherein the voiced period estimator estimates the voiced period using based on the extracted residual signal.

3. The device according to claim 1, wherein the residual signal extractor extracts the residual signal using linear predictive coefficient analysis, or using partial autocorrelation coefficient analysis, or using line spectrum analysis.

4. The device according to claim 1, wherein the voiced period estimator estimates a voiced period by taking reciprocal of fundamental frequency estimated from the speech signal at each analysis frame, and the phase estimator clips the valid voiced period in the analysis frame and performs estimating the phase based on the pattern matching.

5. The device according to claim 2, wherein, when amplitude value of the residual signal is equal to or greater than a threshold value, the voiced period estimator generates a time sequence corresponding to time of each of the residual signal and estimates the voiced period based on the timing sequence.

6. The device according to claim 1, wherein the storage stores a plurality of pulse signals modulated phases which are quantized between $-\pi$ and $\pi$.

7. The device according to claim 1, wherein the phase estimator performs the pattern matching in units of the analysis frame having a pitch mark determined according to the residual signal at center to estimate the sequence of phases of the speech signal.

8. The device according to claim 1, wherein, after estimating phase of leading pitch mark, the phase estimator performs the pattern matching for each pitch mark to estimate the sequence of phases of the speech signal.

9. The device according to claim 8, wherein the phase estimator determines the leading pitch mark based on timing at which amplitude of the residual signal is greatest in the analysis frame or based on timing at which absolute value of inclination of the residual signal is greatest in the analysis frame.

10. The device according to claim 8, wherein the phase estimator performs the pattern matching in units of the analysis frame having a pitch mark determined according to the residual signal at center to estimate the sequence of phases of the speech signal.

11. The device according to claim 1, wherein the phase estimator performs the pattern matching with respect to a time domain waveform.

12. The device according to claim 11, wherein the phase estimator estimates, as the phase of the speech signal, phase value of either one of the plurality of pulse signals having greatest correlation coefficient with respect to the residual signal.

13. The device according to claim 11, wherein the phase estimator estimates, as the phase of the speech signal, phase value of either one of the plurality of pulse signals having smallest difference in amplitude value with respect to the residual signal.

14. The device according to claim 11, wherein the watermark determiner determines presence or absence of a digital watermark in the speech signal based on mode value of inclination of phase estimated by the phase estimator.

15. A digital watermark detecting method comprising:

extracting a residual signal from a speech signal;

estimating a voiced period based on the speech signal;

clipping the voiced period in units of an analysis frame having a predetermined length;

performing pattern matching between the residual signal in the analysis frame and the plurality of pulse signals to estimate phase of the speech signal; and determining presence or absence of a digital watermark in the speech signal based on a sequence of the estimated phases.

16. A non-transitory computer program product comprising a computer-readable medium containing a program executed by a computer, the program causing the computer to execute:

extracting a residual signal from a speech signal;

estimating a voiced period based on the speech signal;

clipping the voiced period in units of an analysis frame having a predetermined length;

performing pattern matching between the residual signal in the analysis frame and the plurality of pulse signals to estimate phase of the speech signal; and determining presence or absence of a digital watermark in the speech signal based on a sequence of the estimated phases.

* * * * *